US011180229B2

(12) United States Patent
Williams

(10) Patent No.: US 11,180,229 B2
(45) Date of Patent: Nov. 23, 2021

(54) WATER SAFETY ROPE AND ALARM SYSTEM

(71) Applicant: MAN OVERBOARD MARINA ALARM SYSTEMS PTY LTD, Victoria (AU)

(72) Inventor: Paul J. Williams, Victoria (AU)

(73) Assignee: MAN OVERBOARD MARINA ALARM SYSTEMS PTY LTD, Victoria (AU)

( * ) Notice: Subject to any disclaimer, the term of this patent is extended or adjusted under 35 U.S.C. 154(b) by 0 days.

(21) Appl. No.: 16/964,065

(22) PCT Filed: Jan. 24, 2019

(86) PCT No.: PCT/AU2019/050048
§ 371 (c)(1),
(2) Date: Jul. 22, 2020

(87) PCT Pub. No.: WO2019/144188
PCT Pub. Date: Aug. 1, 2019

(65) Prior Publication Data

US 2021/0047018 A1 Feb. 18, 2021

(30) Foreign Application Priority Data

Jan. 25, 2018 (AU) ..... 2018900247

(51) Int. Cl.
*B63C 9/00* (2006.01)
*G08B 7/06* (2006.01)
(Continued)

(52) U.S. Cl.
CPC ..... *B63C 9/0005* (2013.01); *B63C 9/00* (2013.01); *D07B 1/14* (2013.01); *D07B 1/145* (2013.01);
(Continued)

(58) Field of Classification Search
CPC ... B63B 2201/02; B63B 2201/04; B63C 9/00; B63C 9/0005; B63C 9/20
See application file for complete search history.

(56) References Cited

U.S. PATENT DOCUMENTS 5,408,221 A * 4/1995 Carsella, Sr. ..... B63B 34/67 340/604
6,257,942 B1 * 7/2001 Groover ..... B63C 9/26 441/84
(Continued)

FOREIGN PATENT DOCUMENTS

CN 205959362 U 2/2017
CN 108230622 A 6/2018

OTHER PUBLICATIONS

International Search Report for related International Application No. PCT/AU2019/050048; report dated Aug. 1, 2019; (4 pages).
(Continued)

*Primary Examiner* — Benyam Haile
(74) *Attorney, Agent, or Firm* — K&L Gates LLP

(57) ABSTRACT

A water safety rope and alarm system, comprising a rope mounted adjacent to a waterline of a marine or aquatic structure; a switch connected to the rope and configured to be triggered when the rope is tensioned; and an alarm connected to the switch and configured to produce an alarm signal when the switch is triggered.

15 Claims, 2 Drawing Sheets

(51) Int. Cl.
*G08B 21/08* (2006.01)
*D07B 1/14* (2006.01)

(52) U.S. Cl.
CPC ..... *D07B 1/148* (2013.01); *G08B 7/06* (2013.01); *G08B 21/08* (2013.01)

(56) References Cited

U.S. PATENT DOCUMENTS

| | | | | |
|---|---|---|---|---|
| 6,935,911 | B1 | 8/2005 | Stewart et al. | |
| 7,059,264 | B1 | 6/2006 | Hall et al. | |
| 10,343,753 | B1 | 7/2019 | Snta-Torres | |
| 2002/0041794 | A1* | 4/2002 | Bostelman | E04G 1/18 405/4 |
| 2006/0205296 | A1 | 9/2006 | Esson | |
| 2011/0134635 | A1 | 6/2011 | Feldman et al. | |
| 2012/0038494 | A1 | 2/2012 | Read et al. | |
| 2013/0019793 | A1* | 1/2013 | Carr | B63B 45/00 116/26 |

OTHER PUBLICATIONS

Written Opinion for related International Application No. PCT/AU2019/050048; report dated Aug. 1, 2019; (7 pages).
Extended European Search Report for related European Application No. 19743744.5; action dated Sep. 16, 2021; (9 pages).

* cited by examiner

WATER SAFETY ROPE AND ALARM SYSTEM

CROSS-REFERENCE TO RELATED APPLICATIONS

The present application is a National Stage of International Application No. PCT/AU2019/050048, filed Jan. 24, 2019, which claims priority to Australian Application No. 2018900247, filed Jan. 25, 2018, the disclosure of which are incorporated herein by reference.

FIELD

The present invention relates to a water safety rope and alarm system.

BACKGROUND

Marinas pose increased safety risks, such as people accidentally falling into the water, becoming trapped, and unable to call for help. Those who fall into this category, risk: incurring injuries while attempting to exit the water; being hospitalized as a result of hypothermia and/or near drowning; or death.

A need therefore exists for solutions that enable a person who falls into the water to raise an alarm if they are unable to get out unaided.

SUMMARY

According to the present invention, there is provided a water safety rope and alarm system, comprising:

a rope mounted adjacent to a waterline of a marine or aquatic structure;

a switch connected to the rope and configured to be triggered when the rope is tensioned; and an alarm connected to the switch and configured to produce an alarm signal when the switch is triggered.

The rope may comprise a high-visibility rope, an illuminated rope light, or a combination thereof.

The rope may be mounted within arm's reach of the waterline of the marine or aquatic structure.

The marine or aquatic structure may comprise a marina, a pontoon, a dock, a wharf, a pier, a breakwater, a dam, a weir, a lock, a yacht basin, a walkway, a boat slip or ramp, and combinations thereof.

The switch may comprise a rope pull switch.

The alarm signal may comprise an audible alarm signal, a visual alarm signal, a haptic alarm signal, an electronic alarm signal, and combinations thereof.

The alarm may comprise a light, a siren, a horn, and combinations thereof.

The system may further comprise an alarm monitoring unit configured to monitor the switch, the alarm, or a combination thereof.

The alarm monitoring unit may be further configured to send an alarm notification to a remote computing device when the switch is triggered.

The system may comprise a plurality of switches mounted in a plurality of zones adjacent to the waterline of the marine or aquatic structure, wherein the alarm monitoring unit is further configured to monitor individual switches of the individual zones.

The alarm monitoring unit may comprise a user interface configured to display individual statuses of the individual switches of the individual zones.

The system may further comprise a manually activated alarm connected to the alarm monitoring unit.

The manually activated alarm may comprise a push-button alarm mounted on the marine or aquatic structure.

The present invention also provides a method of monitoring a marine or aquatic structure using the water safety rope and alarm system described above.

BRIEF DESCRIPTION OF DRAWINGS

Embodiments of the invention will now be described by way of example only with reference to the accompanying drawing, in which.

DESCRIPTION OF EMBODIMENTS

Figure 1:
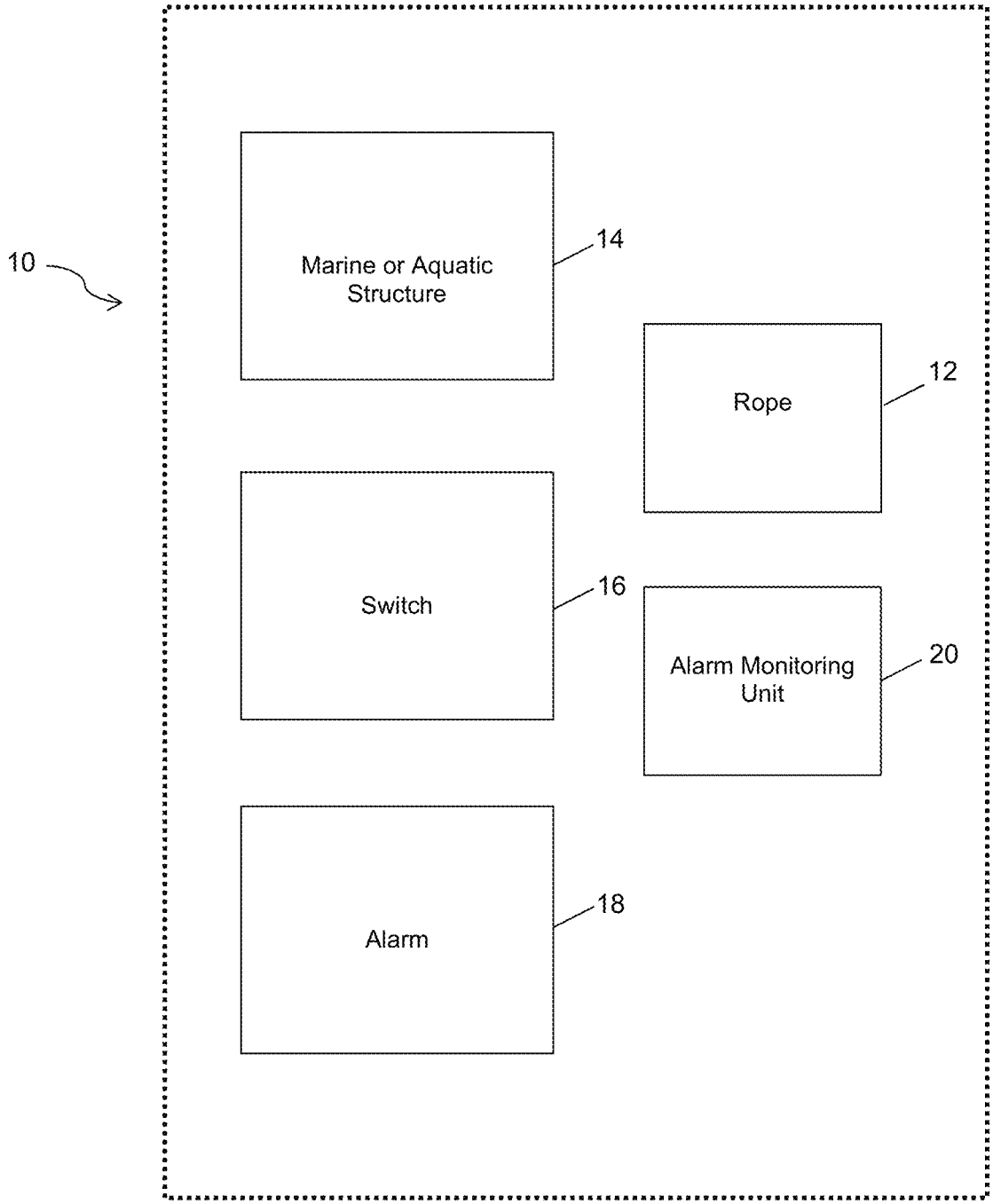
FIG. 1 is a schematic block diagram of a water safety rope and alarm system according to an embodiment of the present invention.

Referring to FIG. 1, a water safety rope and alarm system 10 according to an embodiment of the present invention may generally comprise a rope 12 mounted adjacent above or to a waterline of a marine or aquatic structure 14. The marine or aquatic structure 14 may, for example, comprise a marina, a pontoon, a dock, a wharf, a pier, a breakwater, a dam, a weir, a lock, a yacht basin, a walkway, a boat slip or ramp, and combinations thereof.

Figure 2:
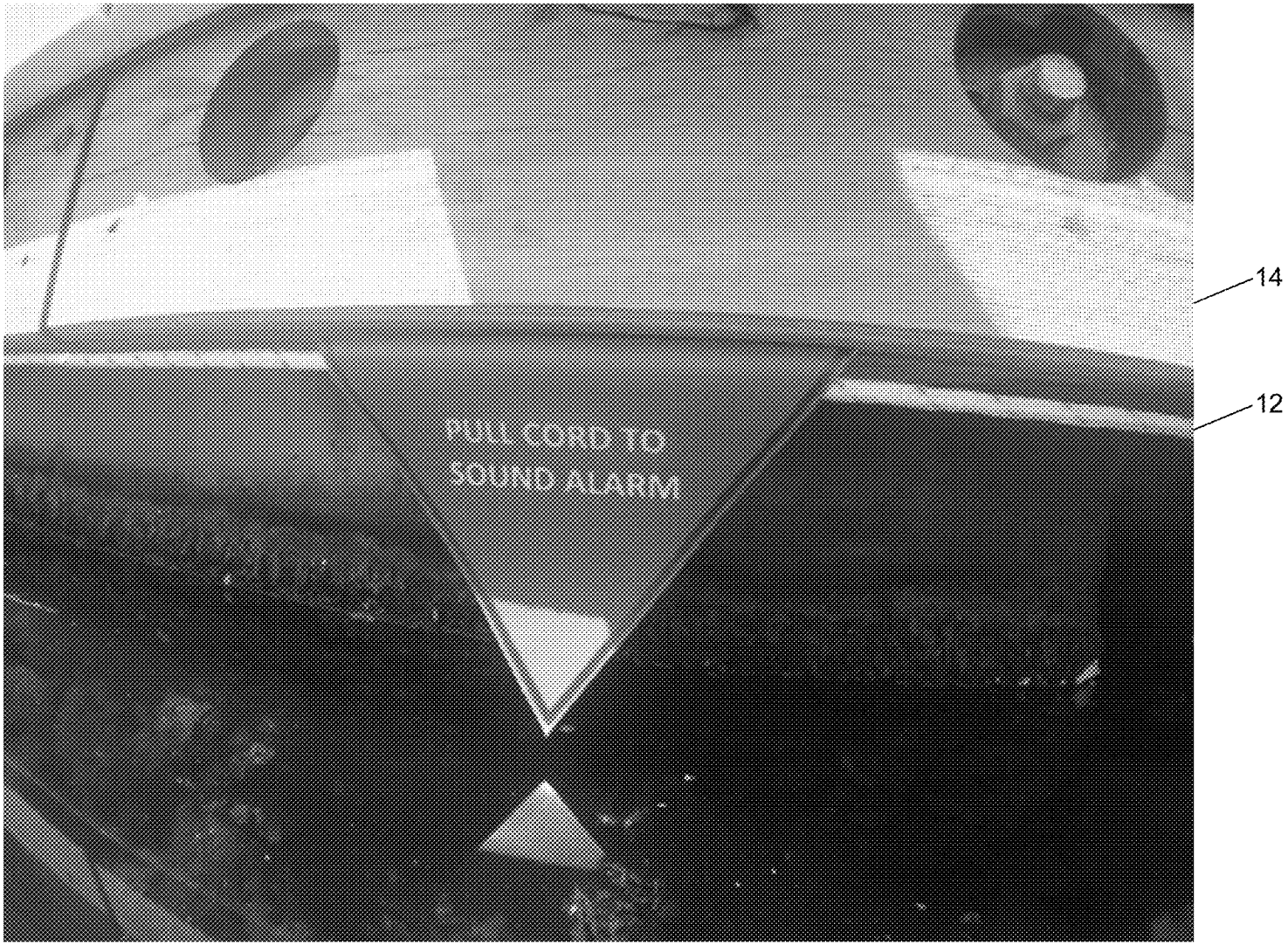
FIG. 2 is a photograph of a safety rope of an embodiment of the system.

As illustrated in FIG. 2, the rope 12 may be mounted within arm's reach of the waterline of the marine or aquatic structure 14, such as a pontoon of a marina. The rope 12 may be mounted to the marine or aquatic structure 14 generally horizontally above the waterline. The rope 12 may comprise a high-visibility rope, an illuminated rope light, or a combination thereof. Optionally, the rope 12 has a waterproof or protective coating. In use, the rope 12 may at least initially provide support for a person who has fallen into the water from the marine or aquatic structure 14 until a rescuer arrives.

The system 10 may further comprise a switch 16 connected to the rope 12 and configured to be triggered when the rope 12 is tensioned by a person who has fallen into the water from the marine or aquatic structure 14. The switch 16 may comprise a rope pull switch mounted to the marine or aquatic structure 14 adjacent to the rope 12. The switch 16 may be connected directly or indirectly to the rope 12. The magnitude and direction of tension forces applied to the rope 12 sufficient to trigger the switch 16 may be based on average human bodyweights and/or average pulling forces exerted by human arms and/or shoulders.

The system 10 may also comprise an alarm 18 connected to the switch 16 and configured to produce an alarm signal when the switch 16 is triggered. The alarm signal may comprise an audible alarm signal, a visual alarm signal, a haptic alarm signal, an electronic alarm signal, and combinations thereof. The alarm 18 may, for example, comprise a light, a siren, a horn, and combinations thereof.

The system 10 may further comprise an alarm monitoring unit 20 (or "dock master" alarm located on the dock) configured to monitor the switch 16, the alarm 18, or a combination thereof. The alarm monitoring unit 20 may be further configured to send an alarm notification to a remote computing device at a "base station" located in a marina office via a wired and/or wireless communication network when the switch 16 is triggered. The wireless communication network may use a wide area network (WAN) communications protocol, for example, LoRaWAN, to enable the low-powered switches 16 to communicate with Internet-connected applications over long range wireless connections. The remote computing device may be associated with or monitored by a marina operator and/or a water rescue service. The remote computing device may, for example, comprise one or more remote servers, desktop computers, laptop computers, tablet computers, smartphones, and combinations thereof. The alarm notification may, for example, comprise a push notification, such as a text, sent to or displayed on a smartphone associated with a water rescuer. The notification may include information to enable the rescuer to identify and access the marina location or pontoon where the alarm has been triggered. For example, the notification may give the location of alarm and a code to get through the pontoon gate (or the code to a lock box with a key to get through the gate).

The system 10 may be scaled up to comprise a plurality of switches 16 and a plurality of ropes 12 mounted in a daisy chain manner in a plurality of zones adjacent to the waterline of the marine or aquatic structure 14. Each rope 12 may be operatively connected to at least two switches 16 to provide fail safe operation so that if one switch 16 becomes inoperative, a second switch 16 may be triggered. The switches 16 may, for example, comprise internet-of-things (IoT) devices powered by one or more of battery, solar and mains power. The alarm monitoring unit 20 may be further configured to monitor individual switches 16 of the individual zones of the marine or aquatic structure 14. The alarm monitoring unit 20 may comprise a user interface configured to display individual statuses of the individual switches 16 of the individual zones. The user interface may display the location of an individual zone of the marine or aquatic structure 14 where an individual switch 16 has been triggered. This may assist a water rescue service to locate where a person has fallen into the water from the marine or aquatic structure 14.

The user interface and the alarm monitoring services provided by the alarm monitoring unit 20 may be provided as SaaS (Software as a Service) to subscribers of a water safety alarm monitoring service, such as owners or operators of the marine or aquatic structure 14. The cost of the SaaS may be at least partially offset by price reductions or rebates under insurance policies.

One embodiment of the system 10 may generally comprise the following five components:

- high visibility yellow rope 12 which extends around the external edge of a marina berth 14;
- pull switch mechanisms 16 attached to the high visibility rope 12;
- a dock master alarm 18 which is a local alarm located on the marina dock 14;
- a central base station or system 20 located in the marina office; and
- a SMS messaging and monitoring service and/or a cloud based "Man Overboard" mobile app that includes a database server configured to send instant text messaging on activation of an alarm in a marina to nominated contacts.

In this embodiment, the high visibility rope 12 may be protected under the top deck surface on a standard floating marina platform 14. It does not interfere with boats, does not require mains power, and does not create or add to trip hazards already found on a marina platform 14.

An example use case of this embodiment of the system 10 is as follows. A person falls into the water at the marina and is unable to get out unaided. They pull on the rope 12 which extends around the external edge of every berth 14. The pull switch mechanism 16 attached to the high visibility rope 12 activates the Dock Master alarm 18 which emits a high pitch sound and strobe light, and sends a signal to the base system 20.

The base station 20 generates an alert and sends an instant text message to people who have programmed their numbers into or registered with Man Overboard app of the system 10, alerting them of the marina location or berth where the alarm has been triggered. Users of the Man Overboard app then have the choice to either investigate the alert or decline. If no-one is able to investigate and everyone declines, then emergency services are contacted. The system is monitored and each alarm trigger is investigated and reported on.

In other embodiments, the system 10 may optionally comprise a duress alarm (not shown) configured to sit on the dock posts (power or pylons that hold floating platforms on place) of the marina 14. In use, the duress alarm may be manually activated by a user to trigger an alarm and a notification in similar fashion to the pull ropes 12 described above.

Embodiments of the present invention provide a water safety rope and alarm system that is both generally and specifically useful for reducing the risk of drowning for persons who fall into the water from marine or aquatic structures.

For the purpose of this specification, the word "comprising" means "including but not limited to," and the word "comprises" has a corresponding meaning.

The above embodiments have been described by way of example only and modifications are possible within the scope of the claims that follow.

The invention claimed is:

1. A water safety rope and alarm system, comprising:

a peripheral rope disposed at least partially around marine or aquatic structure and mounted within arm's reach of a waterline;

a plurality of switches connected at predetermined locations along the rope and configured to be triggered when the rope is tensioned; and an alarm connected to the plurality of switches and configured to produce an alarm signal when any one of the plurality of switches is triggered, wherein the alarm signal indicates the predetermined location of the triggered switch along the rope.

2. The system of claim 1, wherein the rope comprises a high-visibility rope, an illuminated rope light, or a combination thereof.

3. The system of claim 1, wherein the marine or aquatic structure comprises a marina, a pontoon, a dock, a wharf, a pier, a breakwater, a dam, a weir, a lock, a yacht basin, a walkway, a boat slip or ramp, or combinations thereof.

4. The system of claim 1, wherein each of the switches comprises a rope pull switch.

5. The system of claim 1, wherein the alarm signal comprises an audible alarm signal, a visual alarm signal, a haptic alarm signal, an electronic alarm signal, or combinations thereof.

6. The system of claim 1, wherein the alarm comprises a light, a siren, a horn, or combinations thereof.

7. The system of claim 1, further comprising an alarm monitoring unit configured to monitor each of the plurality of switches, the alarm, or a combination thereof.

8. The system of claim 7, wherein the alarm monitoring unit is further configured to send an alarm notification to a remote computing device when any one of the switches is triggered.

9. The system of claim 7, wherein the plurality of switches are mounted in a plurality of zones adjacent to the waterline of the marine or aquatic structure, and the alarm monitoring unit is configured to individually monitor each of the plurality of switches in the plurality of zones.

10. The system of claim 9, wherein the alarm monitoring unit comprises a user interface configured to display a status of each of the plurality of switches in of the plurality of zones.

11. The system of claim 7, further comprising a manually activated alarm connected to the alarm monitoring unit.

12. The system of claim 11, wherein the manually activated alarm comprises a push-button alarm mounted on the marine or aquatic structure.

13. A method of monitoring a marine or aquatic structure using the system of claim 1.

14. The system of claim 1, further comprising a plurality of ropes mounted in a daisy chain manner in a plurality of zones adjacent the waterline of the marine or aquatic structure, each rope comprising a plurality of switches and an alarm monitoring unit configured to monitor each of the plurality of switches along the plurality of ropes, such that tensioning of anyone of the plurality of ropes will trigger an adjacent switch, thereby signaling the alarm monitoring unit to change the status of the adjacent switch.

15. The system of claim 14, wherein the alarm monitoring unit is configured to send a signal or a text to a user interface indicating a location of the triggered switch.

* * * * *